US008382922B2

(12) United States Patent
Sengupta

(10) Patent No.: US 8,382,922 B2
(45) Date of Patent: Feb. 26, 2013

(54) HIGH PERFORMANCE, LOW TOXICITY HYPERGOLIC FUEL

(75) Inventor: Debasis Sengupta, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 0 days.

(21) Appl. No.: 12/781,842

(22) Filed: May 18, 2010

(65) Prior Publication Data

US 2012/0168046 A1 Jul. 5, 2012

Related U.S. Application Data

(62) Division of application No. 11/679,672, filed on Feb. 27, 2007, now Pat. No. 7,749,344.

(51) Int. Cl.

| | |
|---|---|
| ***C06B 47/00*** | (2006.01) |
| ***C06B 25/34*** | (2006.01) |
| ***D03D 23/00*** | (2006.01) |
| ***D03D 43/00*** | (2006.01) |

(52) U.S. Cl. ..... 149/92; 149/1; 149/109.2; 149/109.4

(58) Field of Classification Search ..... 149/92, 149/1, 109.2, 109.4

See application file for complete search history.

(56) References Cited

U.S. PATENT DOCUMENTS

| | | | | |
|---|---|---|---|---|
| 3,971,681 | A * | 7/1976 | Rains et al. | 149/19.8 |
| 6,013,143 | A * | 1/2000 | Thompson | 149/1 |
| 6,210,504 | B1 * | 4/2001 | Thompson | 149/1 |
| 6,962,633 | B1 * | 11/2005 | McQuaid | 149/1 |
| 7,749,344 | B2 * | 7/2010 | Sengupta | 149/1 |
| 2005/0022911 | A1 * | 2/2005 | Rusek et al. | 149/1 |
| 2008/0127551 | A1 * | 6/2008 | Stevenson et al. | 44/320 |

* cited by examiner

*Primary Examiner* — James McDonough

(74) *Attorney, Agent, or Firm* — Maschoff Gilmore & Israelsen

(57) ABSTRACT

A group of tertiary amine azides are useful as hypergolic fuels for hypergolic bipropellant mixtures. The fuels provide higher density impulses than monomethyl hydrazine (MMH) but are less toxic and have lower vapor pressures that MMH. In addition, the fuels have shorter ignition delay times than dimethylaminoethylazide (DMAZ) and other potential reduced toxicity replacements for MMH.

16 Claims, No Drawings

HIGH PERFORMANCE, LOW TOXICITY HYPERGOLIC FUEL

CROSS-REFERENCE TO RELATED APPLICATIONS

This application is a divisional of application Ser. No. 11/679,672, filed Feb. 27, 2007.

FEDERALLY SPONSORED RESEARCH OR DEVELOPMENT

The U.S. Government may have certain rights in this invention pursuant to Contract No. W31PQ06C0167 awarded by the U.S. Army

BACKGROUND OF THE INVENTION

1. Field of the Invention

The present invention relates to a hypergolic rocket fuels that simultaneously possess high-performance propellant characteristics and low toxicity relative to Monomethylhydrazine (MMH). The fuels provide propellant performance as high as or higher than MMH, but have lower toxicity.

2. Description of Related Art

Monomethylhydrazine (MMH) is a widely employed fuel in hypergolic, bipropellant systems. MMH possesses desirable propellant properties but it is highly toxic, carcinogenic, and corrosive. Although gelling has dramatically improved the safety of handling and storing the propellant, its toxicity and carcinogenicity are still of major concern. Therefore, there is a need for alternative liquid hypergolic fuels that are less carcinogenic and less toxic than MMH but also have equal or higher energy densities, lower vapor pressures and ignition delays than MMH. These fuels, like MMH, may be used in the form of gels to further improve safety.

Although DMAZ is hypergolic, its ignition delay with IRFNA is significantly longer than MMH. A longer ignition delay requires a larger combustion chamber to avoid pressure spikes that can damage the engine.

U.S. Pat. No. 6,013,143 discloses three chemicals, each comprising a tertiary nitrogen and an azide functional group that are hypergolic when mixed with an oxidizer such as IRFNA, hydrogen peroxide, nitrogen tetroxide, and hydroxyl ammonium nitrate. The chemicals are dimethylaminoethylazide (DMAZ), pyrollidineylethylazide (PYAZ), and bis (ethyl azide)methylamine (BAZ). Inhibited Red Fuming Nitric Acid (IRFNA) type IIIB and monomethyl hydrazine (MMH) deliver a specific impulse of 284 $lb_f$ sec/$lb_m$ and a density impulse of 13.36 $lb_f$ sec/cubic inch in a rocket engine operating a pressure of 2000 psi. DMAZ, PYAZ, and BAZ are proposed as potential replacements for MMH. DMAZ, under the same conditions as MMH, delivers a specific impulse of 287 $lb_f$ sec/$lb_m$ and a density impulse of 13.8 $lb_f$ sec/cubic inch. The patent discloses the mixing of the hypergolic fuel chemicals with gellants and additives such as aluminum and boron to increase specific impulse and density impulse values.

U.S. Pat. No. 6,926,633 discloses a family of amine azides having cyclic structures and for use as hypergolic rocket propellants. The amine azide compounds comprise at least one amine, including tertiary amines, and an azide functional group pendant from a cyclic structure. The propellants are disclosed as being used with oxidizers and, optionally with catalysts present in fuel or oxidizer. Fuel properties for the amine azides are provided based on computational quantum chemistry calculations.

U.S. Pat. No. 6,949,152 discloses hypergolic propulsion systems comprising a fuel composition and an oxidizer composition. The fuel composition contains an azide compound having at least one tertiary nitrogen and at least one azide functional group. The oxidizer contains hydrogen peroxide in water. The hypergolic reaction between oxidizer and fuel is catalyzed by a transition metal, preferably compounds of cobalt and manganese.

Unlike hypergolic fuels disclosed previously, the present fuels exhibit lower toxicity and higher performance than MMH. The fuels require no catalyst to achieve high performance and are hypergolic with commonly used oxidizers. The fuels of the present invention may be used alone, in combination with each other, or in combination with other fuels in blends.

BRIEF SUMMARY OF THE INVENTION

The present invention is a group of tertiary amine azide chemicals useful as hypergolic fuels for hypergolic bipropellant mixtures. The fuels provide higher density impulses than MMH but are less toxic and have lower vapor pressures that MMH. In addition, the fuels have shorter ignition delay times than DMAZ and other potential reduced toxicity replacements for MMH.

DETAILED DESCRIPTION OF THE INVENTION

The present invention is a rocket fuel composition comprising one or more of the molecules I-XIII.

(I)

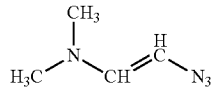

(II)

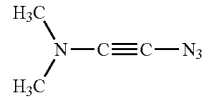

(III)

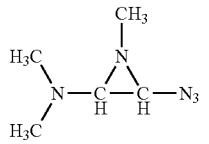

(IV)

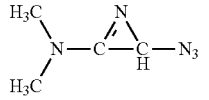

(V)

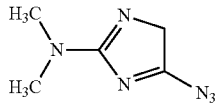

(VI)

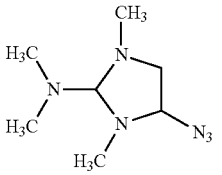

-continued (VII)

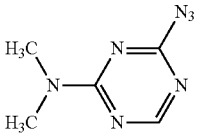

(IX)

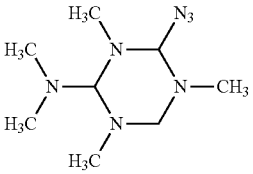

(X)

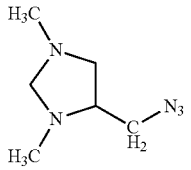

(XI)

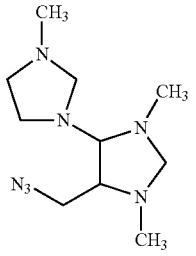

(XII)

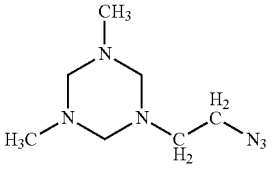

(XIII)

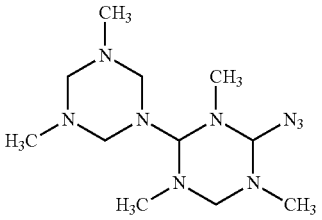

The fuel is hypergolic when combined with a strong oxidizer such as IRFNA, hydrogen peroxide, nitrogen tetroxide, or hydroxyl ammonium nitrate. Relevant chemical and physical properties of the molecules have been calculated using validated molecular modeling techniques, including quantum chemistry and Conductor-like Screening MOdel for Real Solvent (COSMO-RS) methods. The fuel molecules have one or more improved propellant properties relative to MMH and DMAZ including heat of formation, density, vapor pressure, absence of N—N single bonds, and short ignition delay.

Heats of Formation

First-principle ab initio quantum chemistry methods are the most accurate and suitable technique for calculations of molecular geometries, heats of formations, and activation barriers. The procedure numerically solves a many-electron Schrödinger equation to obtain a molecular wave function and energy. The molecular energies can be used to calculate heats of formation.

CBS-QB3 combined with isodesmonic reaction methods were used to calculate heats of formations and activation barriers. Heat of vaporization was calculated using a COSMO-RS technique. Table 1 shows the computed heats of formation for hydrazine, MMH, DMAZ, and compounds I-XIII. Numbers in parentheses are National Institutes of Standards and Technology (NIST) experimental data. The molecules of the present invention possess higher heats of formation than MMH, and are therefore expected to possess specific impulse values that exceed those for MMH.

TABLE 1

Computed Heats of Formation and Densities

| Molecule | Gas Phase $\Delta H_f^{298K}$ kcal/mol | Gas Phase $\Delta H_f^{298K}$ cal/gm | Predicted Density | Predicted Density with Correlation |
|---|---|---|---|---|
| Hydrazine | 23.8 (22.8) | 744.9 (712.5) | | |
| MMH | 23.0 (22.6) | 500.9 (492.2) | | |
| DMAZ | 73.4 | 643.6 | | |
| I | 96.2 | 858.9 | 1.1320 | 0.9346 |
| II | 149.8 | 1361.9 | 1.1334 | 0.9362 |
| III | 110.1 | 781.0 | 1.2114 | 1.0246 |
| IV | 134.8 | 1078.2 | 1.3325 | 1.1619 |
| V | 112.2 | 738.3 | 1.4048 | 1.2438 |
| VI | 90.0 | 489.0 | 1.2153 | 1.0290 |
| VII | 112.2 | 679.7 | 1.3801 | 1.2158 |
| VIII | 110.0 | 516.3 | 1.2347 | 1.0510 |
| IX | 114.3 | 747.2 | 1.2449 | 1.0626 |
| X | 89.6 | 577.8 | 1.1381 | 0.9415 |
| XI | 128.5 | 537.6 | 1.3249 | 1.1532 |
| XII | 106.5 | 578.9 | 1.2433 | 1.0608 |
| XIII | 144.6 | 510.9 | 1.2539 | 1.0728 |

Densities

Once the molecular volume is known, the density can be computed using molecular weight. Molecular volume, defined as the volume occupied by 0.001 au (1 au=6.748 e/Angstrom) electron density envelope, was calculated for eah of I-XIII. Calculated and known densities were compared for a number of amines and amine azides to validate density calculations. Calculations were performed at the PBEPBE/6-311++G(d,p) level. Table 1 shows calculated densities with and without a corrective correlation.

Density Impulses

Specific and density impulse are the two most important parameters describing the performance of a fuel. Density impulse is a measure of the performance per volume of the fuel. Table 2 shows the computed specific and density impulse for each of the molecules I-XIII with IRFNA as the oxidizer.

TABLE 2

Computed Specific and Density Impulse

| Molecule | Specific Impulse $I_{sp}$ ($lb_f$-sec/$lb_m$) | Density Impulse density*$I_{sp}$*$10^{-3}$ ($lb_f$-sec/$ft^3$) | % Improvement over MMH |
|---|---|---|---|
| I | 280.0 | 16.3 | 4.1 |
| II | 286.4 | 16.7 | 6.6 |

TABLE 2-continued

| Computed Specific and Density Impulse | | | |
|---|---|---|---|
| Molecule | Specific Impulse $I_{sp}$ ($lb_f$-sec/$lb_m$) | Density Impulse density*$I_{sp}$*$10^{-3}$ ($lb_f$-sec/$ft^3$) | % Improvement over MMH |
| III | 280.2 | 17.9 | 14.2 |
| IV | 280.7 | 20.4 | 29.7 |
| V | 272.4 | 21.2 | 34.7 |
| VI | 276.8 | 17.8 | 13.3 |
| VII | 267.8 | 20.3 | 29.5 |
| VIII | 278.0 | 18.2 | 16.2 |
| IX | 283.4 | 18.8 | 19.7 |
| X | 277.5 | 16.3 | 3.9 |
| XI | 277.6 | 20.0 | 27.3 |
| XII | 279.0 | 18.5 | 17.7 |
| XIII | 278.4 | 18.6 | 18.8 |

The Isp values were calculated using the PROPEP thermochemical code and correspond to the optimum fuel/IRFNA ratio.

Synthesis of Hypergolic Fuels

The molecules of the present invention may be synthesized by those skilled in the art using known chemical synthetic reactions. For example, the synthesis of compound V can be accomplished by the using the known condensation of guanidines with haloacetates followed by reaction with $PCl_5$ and treatment with $NaN_3$. Compound VII can be prepared from 2,4-dichlorotriazine by sequential substitution of the chlorine atoms. The dichloride 5 can be prepared by condensation of iminyl chloride. The preparation of compound XII can be accomplished, for example, by transamination between two symmetric triazinanes.

The invention claimed is:

1. A hypergolic bipropellant combination comprising an oxidizer and a fuel, said fuel comprising an amine azide chemical having a structure of one of the structures of V, VI, VII, VIII, IX, X, XI, XII, or XIII:

(V)

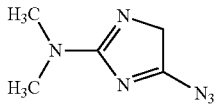

(VI)

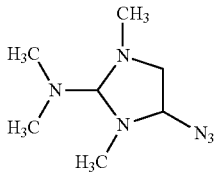

(VII)

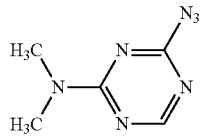

(VIII)

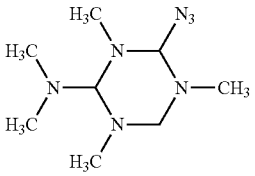

-continued (IX)

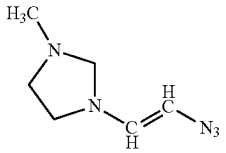

(X)

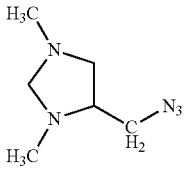

(XI)

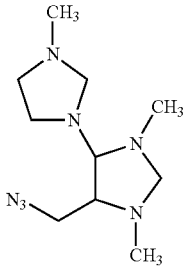

(XII)

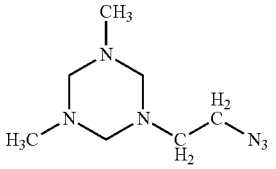

and (XIII)

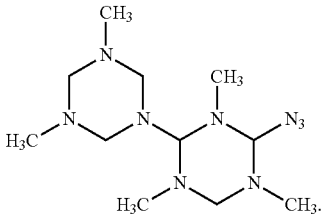

2. The hypergolic bipropellant combination of claim 1, further comprising a gallant mixed with the fuel or the oxidizer.

3. The hypergolic bipropellant combination of claim 1, wherein the oxidizer is selected from IRFNA, hydrogen peroxide, nitrogen tetroxide, and hydroxyl ammonium nitrate.

4. The hypergolic bipropellant combination of claim 1, wherein the fuel is a mixture comprising the amino azide chemical as an additive.

5. A hypergolic bipropellant combination comprising an oxidizer and a fuel, said fuel comprising an amine azide chemical having the structure:

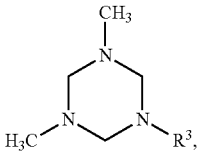

, wherein $R^3$ is $CH_2CH_2N_3$ or

-continued

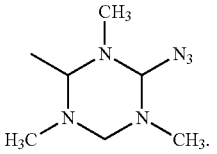

6. The hypergolic bipropellant combination of claim 5, further comprising a gellant mixed with the fuel or the oxidizer.

7. The hypergolic bipropellant combination of claim 5, wherein the oxidizer is selected from IRFNA, hydrogen peroxide, nitrogen tetroxide, and hydroxyl ammonium nitrate.

8. The hypergolic bipropellant combination of claim 5, wherein the fuel is a mixture comprising the amine azide chemical as an additive.

9. The hypergolic bipropellant combination of claim 5, wherein said fuel comprising an amine azide chemical having the structure XII:

(XII)

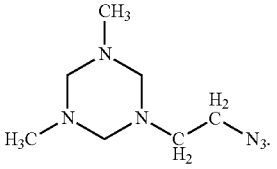

10. The hypergolic bipropellant combination of claim 9, further comprising a gellant mixed with the fuel or the oxidizer.

11. The hypergolic bipropellant combination of claim 9, wherein the oxidizer is selected from IRFNA, hydrogen peroxide, nitrogen tetroxide, and hydroxyl ammonium nitrate.

12. The hypergolic bipropellant combination of claim 9, wherein the fuel is a mixture comprising the amine azide chemical as an additive.

13. The hypergolic bipropellant combination of claim 5, wherein said fuel comprising an amine azide chemical having the structure XIII:

(XIII)

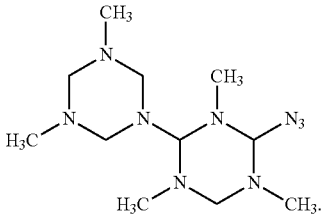

14. The hypergolic bipropellant combination of claim 13, further comprising a gellant mixed with the fuel or the oxidizer.

15. The hypergolic bipropellant combination of claim 13, wherein the oxidizer is selected from IRFNA, hydrogen peroxide, nitrogen tetroxide, and hydroxyl ammonium nitrate.

16. The hypergolic bipropellant combination of claim 13, wherein the fuel is a mixture comprising the amine azide chemical as an additive.

* * * * *

UNITED STATES PATENT AND TRADEMARK OFFICE

CERTIFICATE OF CORRECTION

PATENT NO. : 8,382,922 B2
APPLICATION NO. : 12/781842
DATED : May 18, 2010
INVENTOR(S) : Sengupta It is certified that error appears in the above-identified patent and that said Letters Patent is hereby corrected as shown below:

Column 1

In Column 1, Lines 13-15, delete "The U.S. Government may have certain rights in this invention pursuant to Contract No. W31PQ06C0167 awarded by the U.S. Army" and insert -- This invention was made with Government support under contract W31P4Q-06-C-0167 awarded by the US Army. The Government has certain rights in this invention. --, therefore.

Signed and Sealed this
Ninth Day of April, 2013

Teresa Stanek Rea
*Acting Director of the United States Patent and Trademark Office*